US009578966B2

(12) United States Patent
Paoletti

(10) Patent No.: US 9,578,966 B2
(45) Date of Patent: Feb. 28, 2017

(54) COLLAPSIBLE PORTABLE STRUCTURES THAT CONVERT TO ARTICLES OF FURNITURE WHEN FILLED WITH SAND

(71) Applicant: Jodie A. Paoletti, Avondale, PA (US)

(72) Inventor: Jodie A. Paoletti, Avondale, PA (US)

( * ) Notice: Subject to any disclaimer, the term of this patent is extended or adjusted under 35 U.S.C. 154(b) by 90 days.

(21) Appl. No.: 14/529,821

(22) Filed: Oct. 31, 2014

(65) Prior Publication Data

US 2016/0120325 A1 May 5, 2016

(51) Int. Cl.

| | |
|---|---|
| ***A47C 13/00*** | (2006.01) |
| ***A47C 1/14*** | (2006.01) |
| ***A47C 4/54*** | (2006.01) |
| ***A47C 7/62*** | (2006.01) |
| ***A47G 9/06*** | (2006.01) |
| ***A47C 27/08*** | (2006.01) |
| ***A47C 3/16*** | (2006.01) |
| ***A47D 11/00*** | (2006.01) |

(52) U.S. Cl.

CPC ..... *A47C 1/146* (2013.01); *A47C 3/16* (2013.01); *A47C 4/54* (2013.01); *A47C 7/62* (2013.01); *A47C 27/086* (2013.01); *A47D 11/00* (2013.01); *A47G 9/062* (2013.01)

(58) Field of Classification Search

CPC ..... A47C 4/54; A47C 1/14; A47C 1/146

See application file for complete search history.

(56) References Cited

U.S. PATENT DOCUMENTS

| | | | | |
|---|---|---|---|---|
| 2,803,291 A * | 8/1957 | Meyer | A47C 1/146 297/271.6 |
| 3,955,849 A * | 5/1976 | Grebow | A47C 1/14 190/8 |
| 4,011,611 A | 3/1977 | Lederman | |
| 4,942,635 A | 7/1990 | Hargest et al. | |
| 5,301,705 A | 4/1994 | Zheng | |
| 5,800,067 A | 9/1998 | Easter | |
| 6,000,079 A | 12/1999 | Dranger | |
| 6,170,100 B1 * | 1/2001 | Le Gette | A47G 9/062 297/219.1 |

(Continued)

OTHER PUBLICATIONS

Harbor Arm Chair found at http://www.allaboardinc.com/catalog/intensive-use/seating/harbor-arm-chair.

(Continued)

*Primary Examiner* — David R Dunn
*Assistant Examiner* — Tania Abraham
(74) *Attorney, Agent, or Firm* — Panitch Schwarze Belisario & Nadel LLP

(57) ABSTRACT

Portable structures convert into furniture articles, such as chairs, backrests, and tables, when substantially filled with sand and revert to collapsed portable structures for easy transport after a substantial amount of sand has been removed. The portable structures include a cover, made from a flexible and deformable material, and a frame that includes one or more flexible frame members disposed on or incorporated within the cover. The flexible frame members have spring-like characteristics such that a portable structure, without substantial sand therein, can be collapsed for storage and/or transport, and when ready for use, automatically converted to an "uncollapsed pop-up" state adapted to receive sand filling to form the furniture article.

13 Claims, 6 Drawing Sheets

(56) References Cited

U.S. PATENT DOCUMENTS

| | | | | |
|---|---|---|---|---|
| 7,011,373 | B1 * | 3/2006 | Hsieh | A47C 3/029 297/452.17 |
| 2013/0074259 | A1 * | 3/2013 | Snep | A47G 9/062 5/420 |
| 2015/0164228 | A1 * | 6/2015 | Scorgie | A47C 31/006 5/656 |

OTHER PUBLICATIONS

Lonc Seaser chair and Teaser stool found at http://babyology.com.au/furniture/kids-sit-in-style-with-lonc-seaser-chairand-teaser-stool.html.

* cited by examiner

COLLAPSIBLE PORTABLE STRUCTURES THAT CONVERT TO ARTICLES OF FURNITURE WHEN FILLED WITH SAND

BACKGROUND

The field of the invention relates to convertible and collapsible portable structures that convert to articles of furniture, such as chairs, tables, and back rests, when filled or substantially filled with sand, and collapse to a portable structure after substantial removal of the sand.

A favorite pastime enjoyed by millions across the world is spending time at the beach to bask in the sun, swim and enjoy the view. For some, a day spent beside the water can also help ease the stresses of daily life and leave one tanned, relaxed, and well-rested.

Most who plan on spending a day beachside pack at least snacks, a cooler full of icy beverages and sunscreen lotion. Families with children, particularly small children, also typically pack an arsenal of toys, including buckets and shovels to keep tots occupied. And most beachgoers find it necessary to bring a large blanket, large towels, and one or two beach chairs before heading off to the beach. The blankets, towels, and chairs are particularly useful in that they provide sun-worshipers with an area to sit, feel the sun's rays, and enjoy a view of the water.

Hauling all the items necessary for the day at the beach, for example, from the car to a particular spot on the sand, can be a time-consuming and frustrating task. Trekking across hot sand and making several trips to the car in order to transport heavy coolers, blankets, clothes, towels, toys, and beach chairs, all while trying to keep an eye on small children and unattended goods, can leave some feeling exhausted before the day's activities even begin. Then, after spending long hours soaking up the sun, riding the waves, playing, and swimming, packing up all of the same items and dragging them back to the car is the last thing most beachgoers want to do.

Unfortunately, beach toys and chairs just add to the already heavy load of coolers, blankets, towels, bottles of sunscreen, clothes, etc., which families have to take to enjoy a day at the beach. As such, there is a clear need for items that can alleviate the heavy loads of beach goers and particularly families who want to keep children entertained during a day at the beach. The present invention fulfills this need and provides further related advantages, as described below.

BRIEF SUMMARY OF THE DISCLOSURE

The present invention relates to various embodiments of convertible and collapsible portable structures that convert to chairs, backrests, and tables when substantially filled with sand and collapse to portable structures after a substantial amount of sand has been removed. Because the structures disclosed herein are collapsible, they are suitable for easy transport from one area to another, thereby significantly lessening the load of beach-goers. Because the structures are lightweight and supported by sand, they are "ecologically friendly" in that they use a "borrowed" natural resource and provide a reduced carbon footprints, by using a structure that weighs significantly less than to traditional furniture articles brought to the beach.

Moreover, filling the structures with sand, and emptying the sand from such structures, can be fun activities for children and adults during their day at the beach. Children can, for example, "build" a chair, a backrest, or a table while their parents are busy setting up items such as coolers, blankets, clothes, towels in preparation for their day at the beach. The conversion of the portable structures described herein also provide a cost-effective alternative to other configurations of chairs, backrests, and tables that may be brought to the beach.

According to a first embodiment, the convertible and collapsible structure converts to a chair upon filling with sand. According to a second embodiment, the convertible and collapsible structure converts to a husband-type back rest upon filling with sand. Modified versions of these embodiments include inflatable arm rests and an inflatable seat cushion.

The articles of furniture of the first and second embodiments include a cover, made from a flexible and deformable material, and a frame that includes one or more flexible frame members disposed on or incorporated within the cover. Flexible frame members preferably are manufactured from one or more materials that have spring-dike characteristics such that the frame can be bent or collapsed to a portable structure for storage and/or transport and released from the collapsed state to an "uncollapsed pop-up state" when the portable structure is converted into an article of furniture.

As used herein, the term "uncollapsed pop-up state" refers to state of the convertible and collapsible article of furniture that results after the portable structure automatically changes to the desired shape of the final frame form. Stated differently, an "uncollapsed pop-up" state results when the frame is manufactured from materials having spring characteristics such that when the frame is bent or collapsed and thereafter released the frame releases or "pops-up." Such frame materials are stiff yet resilient, and include, but are not limited to, spring steels or wires and plastic materials, having spring constants that allow the frame to automatically pop-up or automatically return to a desired end resulting form. The frame materials may have rectangular or other cross-sections.

The flexible frame members may be formed such that the resulting chair, backrest, or table structure is formed in various types of designs. For example, the outer perimeter of the resulting chair back may have an ornamental shape of a sunburst, a moon, ruffles, dinosaur spikes, etc. As such, the shape of the flexible frame members shown and described herein should not be construed as limiting.

According to a third embodiment, a convertible and collapsible article of furniture converts from a portable structure to an umbrella table, when uprightly positioned and filled or substantially filled with sand. This embodiment includes a top cover and a collapsible bottom structure. The collapsible bottom structure encompasses an outer cylinder, an inner cylinder, and a bottom panel. At least one circular frame preferably is disposed on or within the inner cylinder such that the collapsible bottom has additional support structure when the outer and inner cylinders are uprightly positioned. The top cover is attached to the collapsible bottom cover after the internal volume space between the inner and outer cylinders is filled or substantially filled with sand.

BRIEF DESCRIPTION OF THE SEVERAL VIEWS OF THE DRAWINGS

The foregoing summary, as well as the following detailed description of the invention, is better understood when read in conjunction with the appended drawings. For the purpose of illustrating the invention, there are shown in the drawings embodiments which are presently preferred. It should be understood, however, that the invention is not limited to the precise arrangements and instrumentalities shown and described herein.

In the drawings.

DETAILED DESCRIPTION OF THE INVENTION

Reference will now be made in detail to the various embodiments of the invention, as illustrated in the accompanying drawings. Wherever possible, the same or like reference numbers will be used throughout the drawings to refer to the same or like features. It should be noted that the drawings are in simplified form and not drawn to a precise scale. In reference to the disclosure herein, for purposes of convenience and clarity only, directional terms such as top, bottom, above, below, distal, and transverse, are used with respect to the accompanying drawings. Such directional terms used in conjunction with the following description of the drawings should not be construed to limit the scope of the claimed invention in any manner not explicitly set forth herein. Unless specifically set forth herein, the terms "a", "an" and "the" are not limited to one element but instead should be read as meaning "at least one". The terminology includes the words noted above, derivatives thereof and words of similar import.

Figure 1:
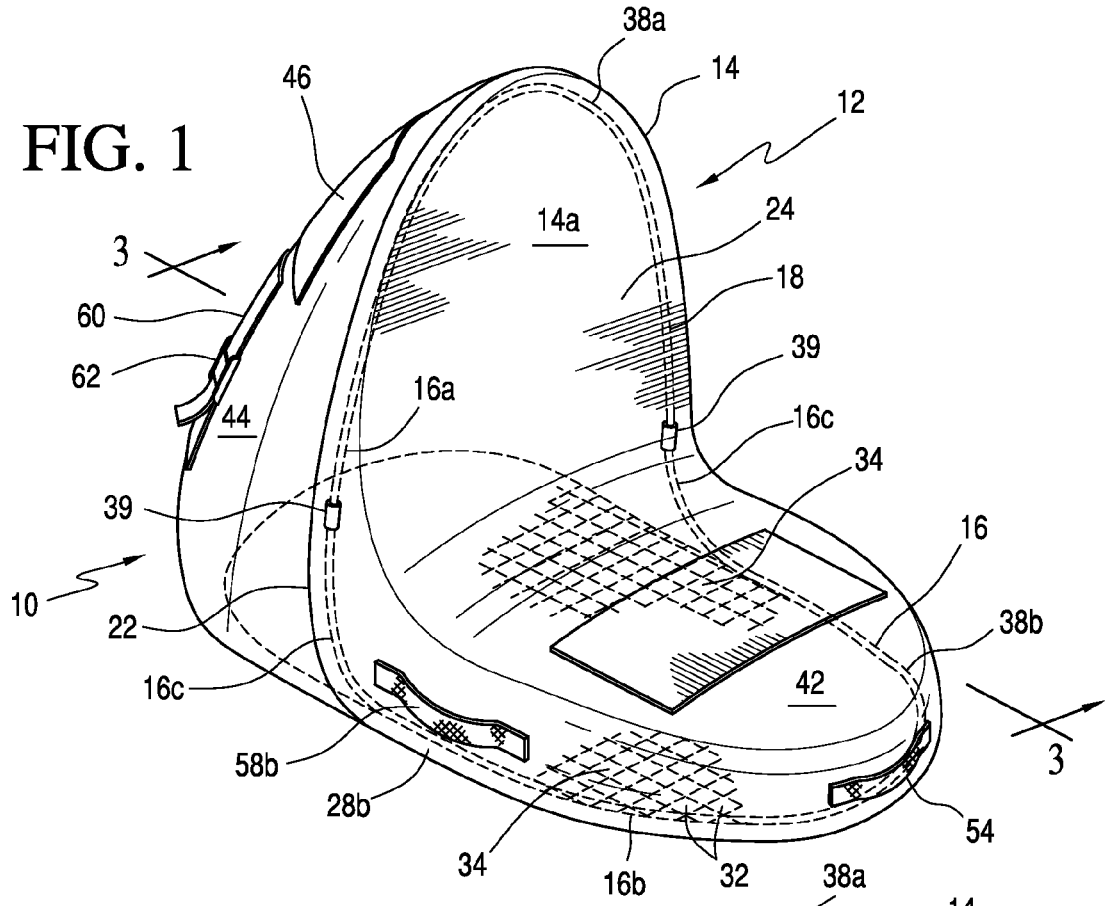
FIG. 1 is a front perspective view of a first embodiment of a convertible and collapsible article of furniture forming a chair.
Figure 2:
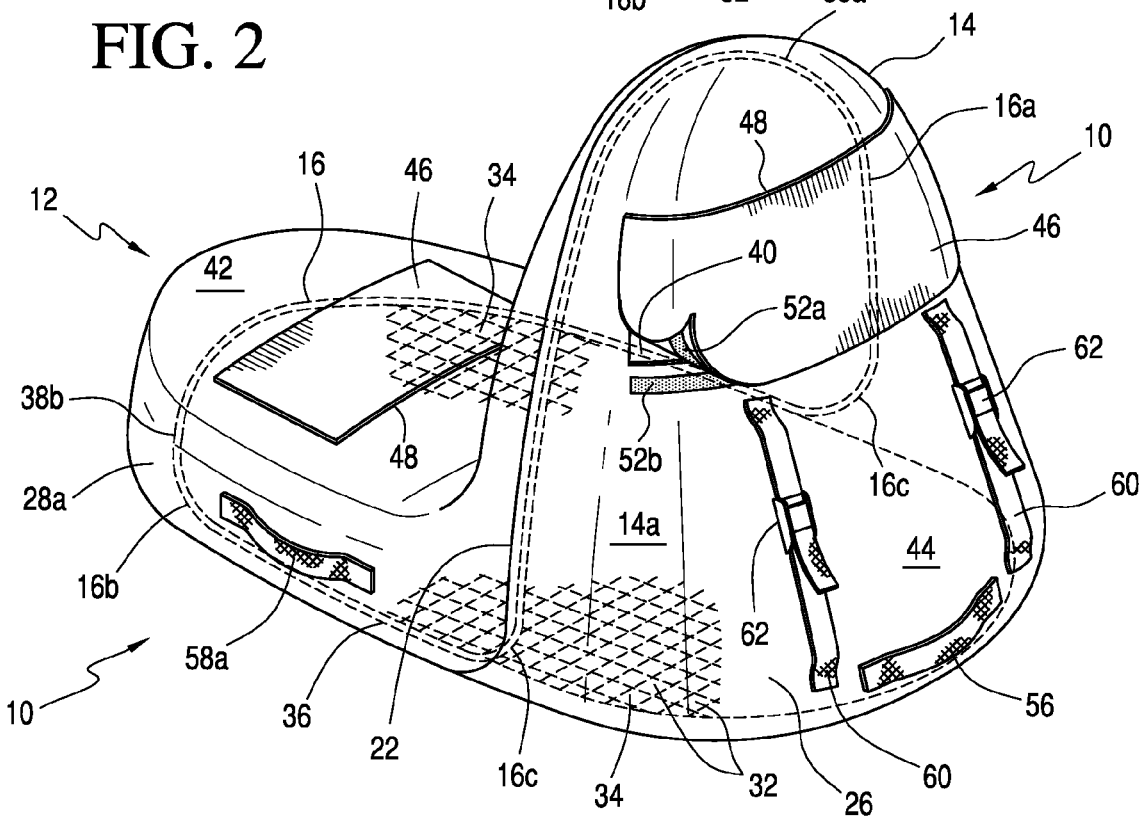
FIG. 2 is a rear perspective view of the convertible and collapsible article of furniture shown in FIG. 1.
Figure 3:
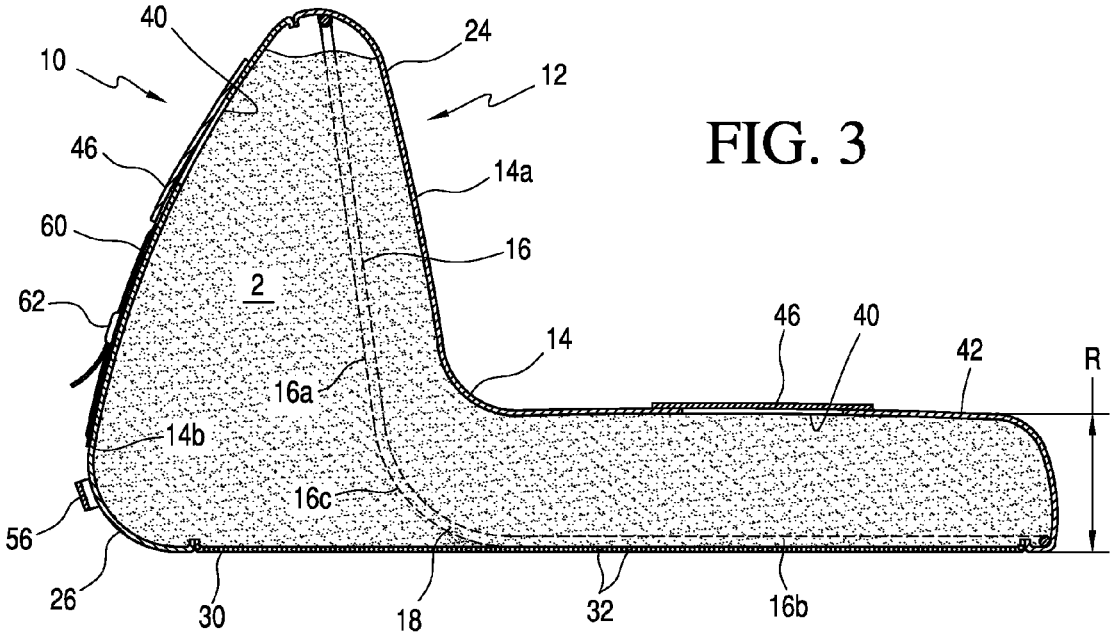
FIG. 3 is a cross-sectional view of the convertible and collapsible article of furniture shown in FIG. 1, taken along line 3-3 of FIG. 1.
Figure 4A:
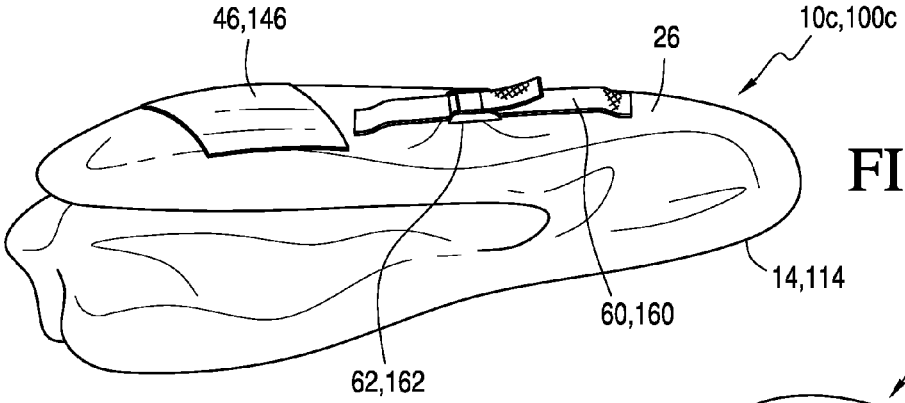
FIGS. 4A and 4B show collapsed states of the convertible and collapsible articles of furniture shown in FIGS. 1-3 and FIGS. 5-9.
Figure 4B:
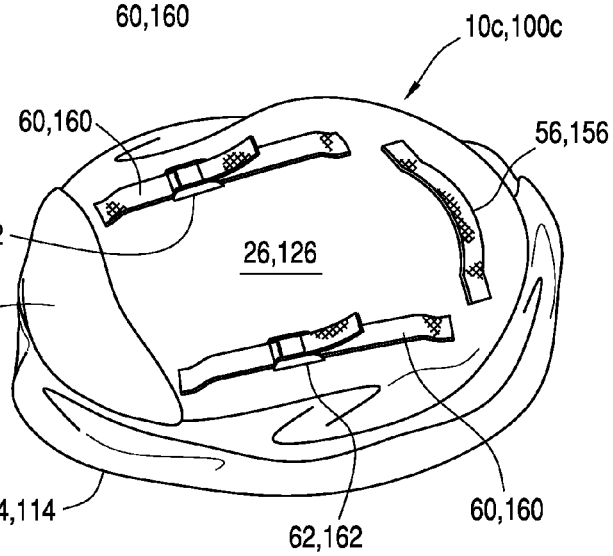
Figure 5:
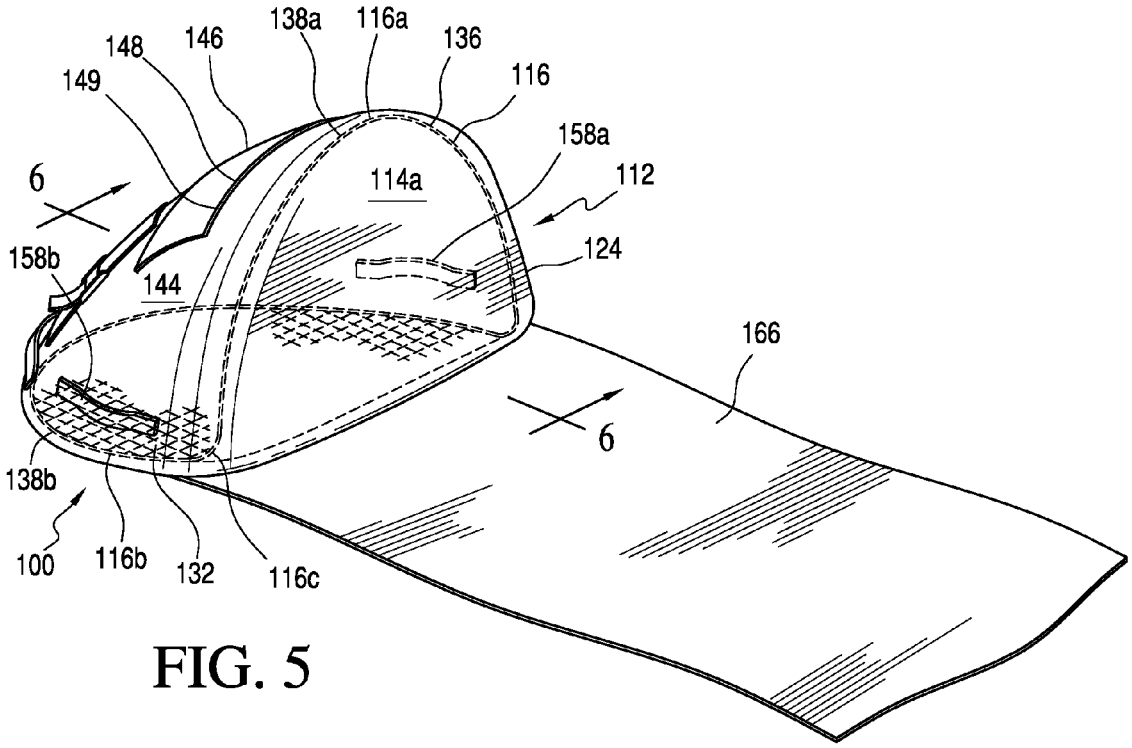
FIG. 5 is a front perspective view of a second embodiment of a convertible and collapsible article of furniture forming a husband-type back rest.
Figure 6:
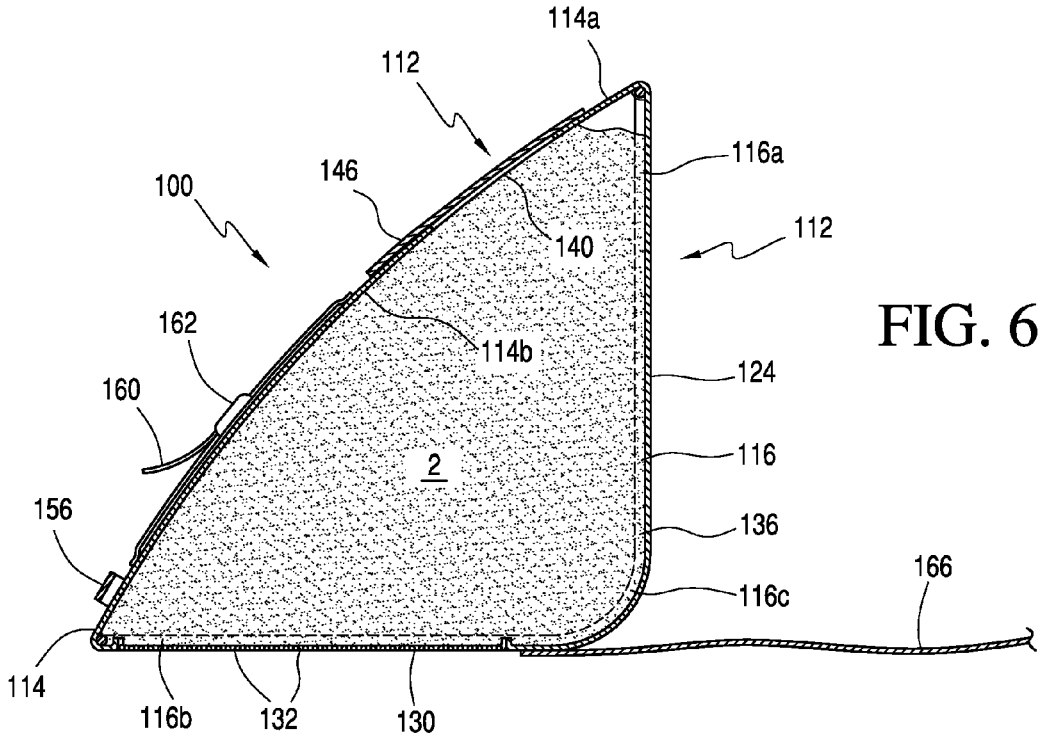
FIG. 6 is a side cross-sectional view of the convertible and collapsible article of furniture shown in FIG. 5 taken along line 6-6 of FIG. 5.
Figure 7:
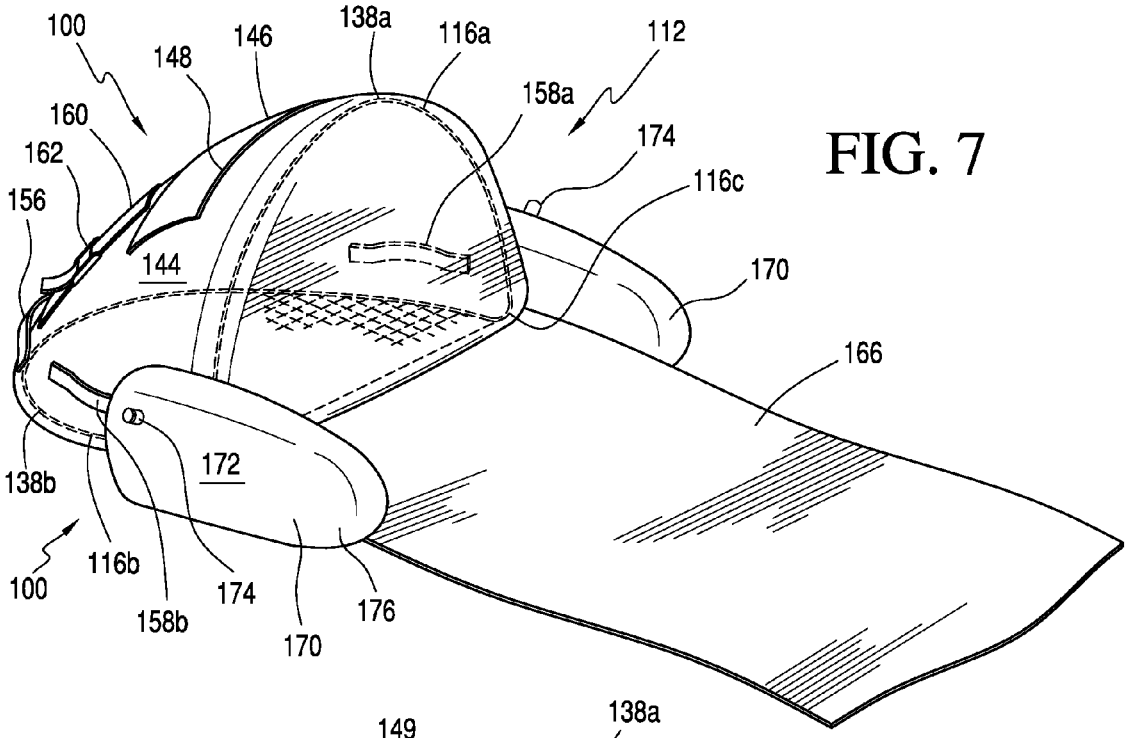
FIG. 7 is a front perspective view of a modified version of the convertible and collapsible article of furniture, shown in FIG. 5, including inflatable arm rest elements.
Figure 8:
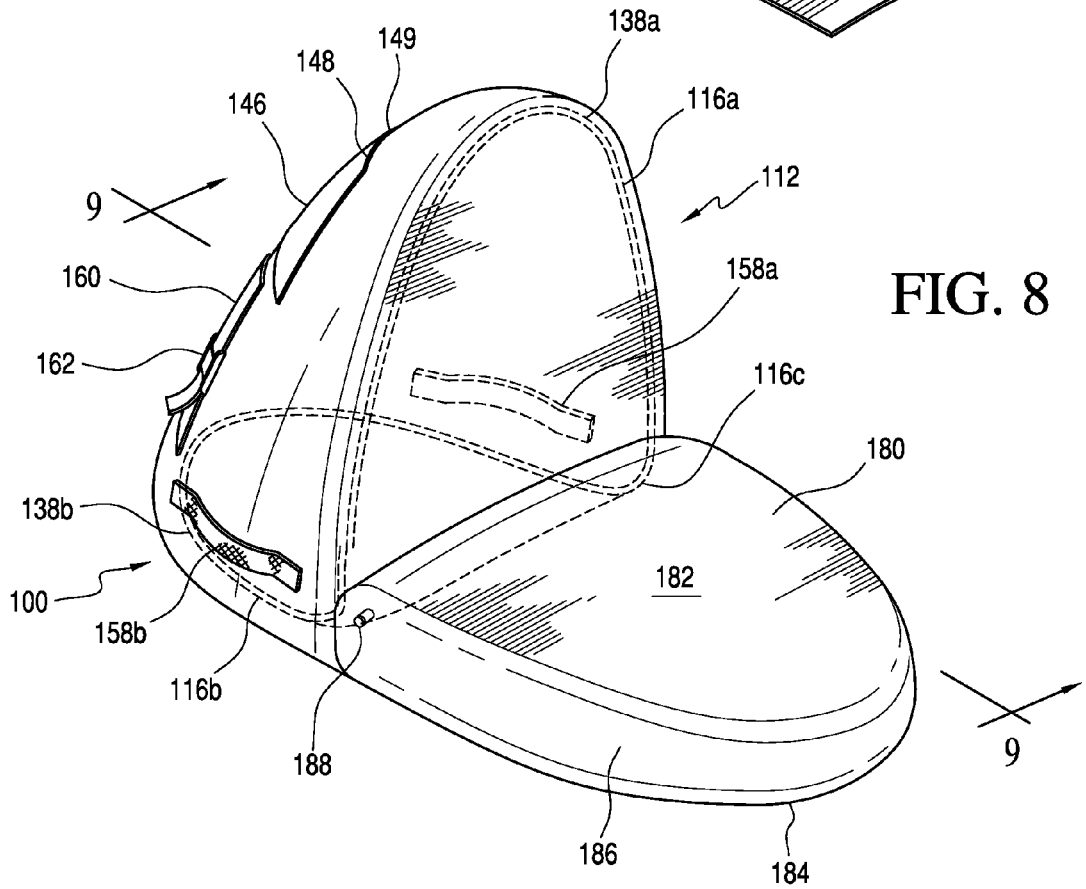
FIG. 8 is a front perspective view of a modified version of the convertible and collapsible article of furniture, shown in FIG. 5, including an inflatable seat element.
Figure 9:
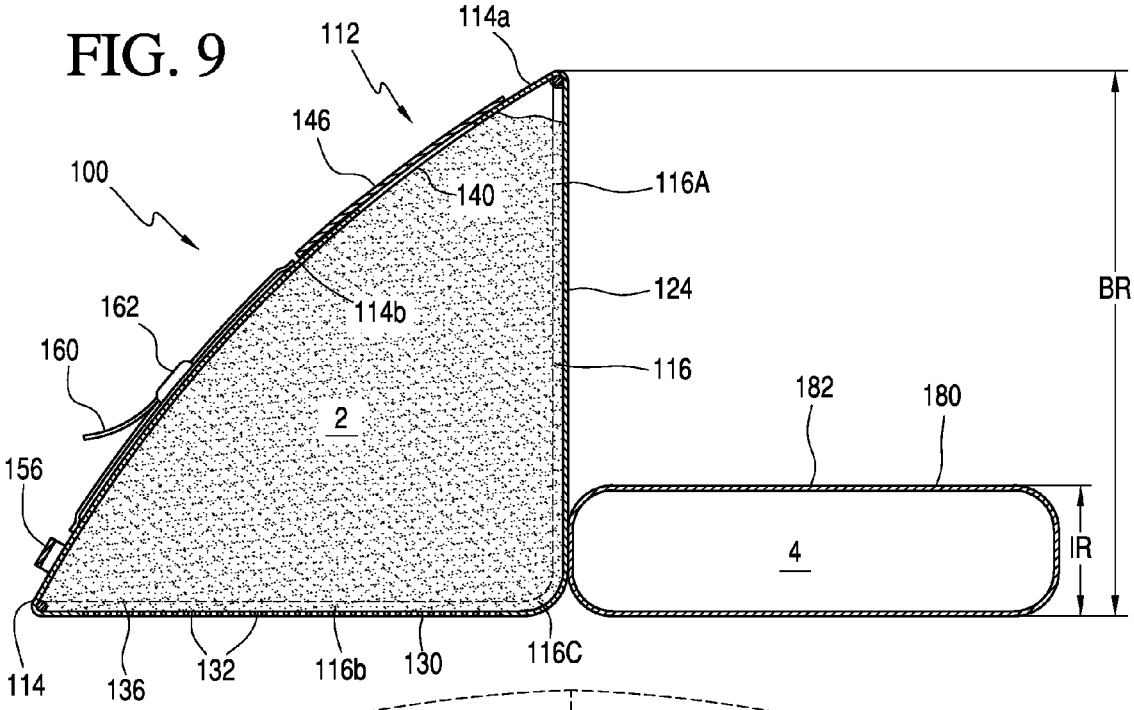
FIG. 9 is a cross-sectional view of the convertible and collapsible article of furniture shown in FIG. 8, taken along line 9-9 of FIG. 8.
Figure 9:
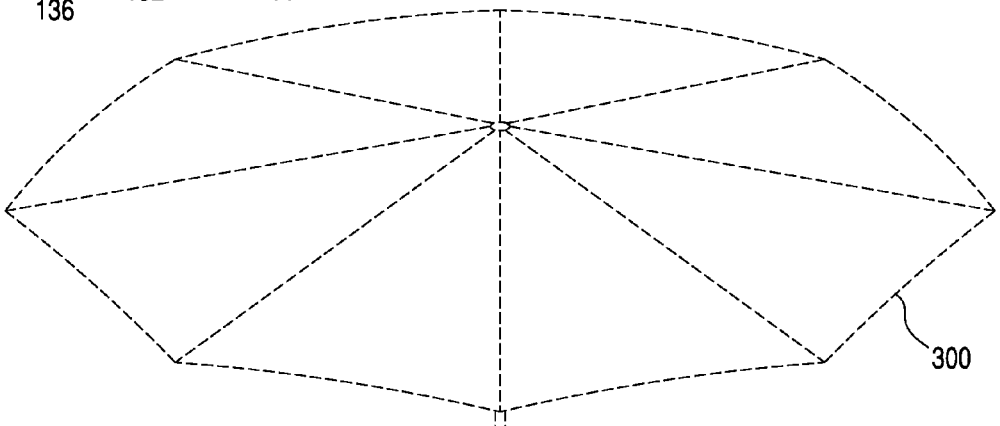

Disclosed herein are various embodiments of convertible and collapsible articles of furniture 10, 100, 200, as shown in FIGS. 1-13, that convert from portable structures 10*c*, 100*c*, 200*c* to chairs, back rests, and tables when the portable structures are filled or substantially filled with sand 2. FIGS. 1-3 show a first embodiment of a convertible and collapsible article of furniture 10, which converts from a portable structure 10*c* into a chair 12. FIGS. 5-6 show a second embodiment of a convertible and collapsible article of furniture 100, which converts from a portable structure 100*c* to a husband-type back rest 112. FIG. 7 shows a modified version of the collapsible article of furniture 100, which includes inflatable arm rests 170. FIGS. 8-9 show a modified version of the second embodiment of the convertible and collapsible article of furniture 100, which includes an inflatable seat cushion element 180. FIGS. 4A-4B show collapsed states of portable structures 10*c*, 100*c* of the embodiments of convertible and collapsible articles of furniture 10, 100 shown in FIGS. 1-3 and 5-9. FIGS. 10-13 shows a third embodiment of a convertible and collapsible article of furniture 200 that converts from a portable structure 200*c* to an umbrella table 212, when uprightly positioned and substantially filled with sand 2 (FIG. 12).

As used herein, the term "sand" should be broadly construed to include beach sand or other flowable material that generally comprises granular particles or grains having a diametrical particle size ranging from about 0.0625 mm (or 1/16 mm) to about 2 mm. Such particles include various types of rocks and mineral particles, including, but not limited to silica (e.g. quartz), calcium carbonate (e.g. aragonite), limestone, feldspar, and gypsum. Such particles may be loose or packed, but are generally flowable and conformable when contained within an enclosed structure.

Referring to FIGS. 1-3, the first embodiment of the convertible and collapsible article of furniture 10 converts to a chair 12 when substantially filled with sand 2 (FIG. 3). The article of furniture 10 includes a cover 14, having an exterior surface 14*a* and an interior surface 14*b*, and a frame 16 disposed on or within the cover 14. The cover 14 defines an internal volume adapted to be filled with sand 2.

The cover 14 is preferably manufactured from a flexible and deformable fabric material 18, having sufficient elasticity to allow the cover 18 to stretch over the frame 16 and provide the chair 12 with a predetermined seat rise R (FIG. 3). The fabric material 18, however, also has enough stiffness to constrain the sand 2 and form the chair 12 when the internal volume is filled or substantially filled with sand 2. Suitable fabric materials include, but are not limited, to nylon or nylon-based materials, polyesters, polyethylenes, canvas treated or coated with moisture barrier(s), and the like.

The cover 14 may be formed with a plurality of cover panels 20 connected by stitching 22. Cover panels 20 may include a front panel 24, a rear panel 26, a right side panel 28*a* (FIG. 2), a left side panel 28*b* (FIG. 1), and a bottom panel 30. The bottom panel 30 preferably includes at least one opening or a plurality of openings 32 that allow sand 2 to fall through to more quickly release sand from the internal volume. The openings 32 may be incorporated into the bottom panel 30 (e.g., holes punched into the bottom panel 30). Alternatively, the bottom panel 30 may be manufactured from a netting or mesh that includes preformed mesh openings that allow sand 2 to pass through. FIGS. 1 and 2 show discrete areas 34 of the bottom panel 30 that include openings 32. Openings 32, however, may extend over the entire bottom panel 30 or in additional discrete areas of the bottom panel 30.

The frame 16 is positioned on or within the cover 14 and may be coupled to the exterior surface 14*a* and/or the interior surface 14*b* of the cover 16. To form the chair 12 when the frame 16 is in an uncollapsed pop-up state, as shown in FIGS. 1-3, the frame 16 includes one or more flexible frame members 36. As such, the frame 16 may be formed as a unitary frame member or assembled from multiple frame members that intersect at optional junctions 39 (shown only in FIG. 1) to form the overall frame 16. If multiple frame members are used, the multiple frame members may be joined together at the junctions 39.

Regardless of whether the frame 16 is constructed from a unitary frame member or assembled from multiple frame members, the frame 16 for the article of furniture 10 includes a back support portion 16*a*, a base support portion 16*b*, and transition portions 16*c* positioned between the back support portion 16*a* and the base support portion 16*b*. The back support portion 16*a* and the base support portion 16*b* have curved contours 38*a*, 38*b*, having a generally U-shape. The overall shapes of back support portion 16*a* and the base support portion 16*b* shown in FIG. 1, however, should not be construed as limiting. The support portions 16*a*, 16*b* may be alternately shaped, depending, in part, on the overall desired shape of the frame 16 and/or the article of furniture 10. For example, the back support portion 16*a* may include multiple curved contours that provide the article of furniture with an ornamental flower-like shape. The base support portion 16*b* and the transition portions 16*c*, according to this embodiment of the article of furniture 10, are directed toward the front of the article of furniture 10. The transitions portion 16*c* may have any shape or contour that effectively couples together the back support portion 16*a* and the base support portion 16*b*.

To fill the portable structure with sand 2 to form an article of furniture 10, the cover 12 includes one or more fill openings 40 through one or more of the cover panels. The fill openings 40 may be formed in any area on the cover 14. FIGS. 1-3 show two fill openings 40 formed in the cover 14, one at a seat area 42 and another at a back area 44 of the cover 14. Each opening may be covered by a flap member 46. At least one edge 48 of each flap member 46 is coupled to the cover 14 using attachment means 49 such as stitching, for example. Preferably, opposite the attached edge 48 of the flap member 46 is a removable/releasable attachment assembly 50. The attachment assembly 50 preferably includes connectors 52*a*, 52*b* (FIG. 2) positioned on complementary surfaces of the flap member 46 and the cover 14. The connectors 52*a*, 52*b* may be, for example hook and loop fasteners or regions or patches of complementary adhesive-based materials that are suitable for repeated connection and reconnection.

After the portable structure has been substantially filled with sand to form an article of furniture 10, such as a chair 12, the chair 12 preferably has a seat rise R up to eighteen (18) inches. As used herein, the seat rise R is the distance from a generally horizontal topmost plane defined by the seat area 42 and a generally horizontal bottommost plane defined by the bottom panel 30. The cover 14 includes enough material that allows for a seat rise up to about eighteen (18) inches.

Handles 54, 56, 58*a*, 58*b* are preferably connected to the cover panels 20 so that the article of furniture 10 may be moved more readily, and may be lifted when it is time to release the sand from the internal volume of the article of furniture 10. The handles 54, 56, 58*a*, 58*b* may respectively connected to the front panel 24, rear panel 26, the right side panel 28*a*, and left side panel 28*b*.

To facilitate transport of the portable structure in its collapsed state, straps 60 may be connected to the cover 14, and preferably connected to the rear panel 26 of the cover 14. The straps 60 may further include adjustment elements 62, such as buckles or hook and loop fasteners that allow a user to change the overall length of the straps 60.

The portable structure 10*c* shown in its collapsed states in FIGS. 4A and 4B is converted to an article of furniture 10 (FIGS. 1-3) by (a) releasing the frame 16 to its unfolded or pop-up state; and (b) inserting sand into the internal volume of the cover 14 through opening(s) 40 to fill or substantially fill the cover 14 with sand 2.

FIGS. 5 and 6 show a second embodiment of a convertible and collapsible article of furniture 100, which converts from a portable structure to a husband-type back rest 112 when substantially filled with sand 2 (FIG. 6). FIG. 7 shows a modified version of the second embodiment, which includes inflatable arm rests 170, and FIGS. 8 and 9 show a modified version of the second embodiment, which includes an inflatable seat cushion 180. Reference numerals of the second embodiment are distinguishable from those of the first embodiment by a factor of one-hundred (100), but otherwise indicate the same elements as indicated in the first preferred embodiment, except as otherwise specified. The description of certain similarities between all embodiments described herein may be omitted for the sake of brevity and convenience, and, therefore, is not limiting.

The article of furniture 100 includes a cover 114, having an exterior surface 114*a* and an interior surface 114*b*, and a frame 116 disposed on or within the cover 114. The cover defines an internal volume adapted for receiving sand. The cover 114 may include a plurality of cover panels 120 connected by stitching 122. Cover panels 120 may include, for example, at least a front panel 124, a rear panel 126 that extends over the sides of the back rest 112, and a bottom panel 130. The bottom panel 130 includes openings 132 that allow sand 2 to fall through to release sand from the internal volume. The openings 132 are either incorporated into the bottom panel 130 or the bottom panel 130 is formed with a netting or a mesh material that includes preformed openings. FIG. 5 shows discrete sections 134 of the bottom panel 130 that include the openings 132. Openings 132 may extend over the entire bottom panel 130, however.

The frame 116 is positioned on or within the cover 114 and coupled to the exterior surface 114*a* and/or the interior surface 114*b* of the cover 116. The frame 116 includes one or more flexible frame members 136. As with the first embodiment, the frame 116 includes a back support portion 116*a*, a base support portion 116*b*, and transition portions 116*c* positioned between the back support portion 116*a* and the base support portion 116*b*. The back support portion 116*a* and the base support portion 116*b* respectively include curved contours 138*a*, 138*b*, having a generally U-shape. The base support portion 116*b* and the transition portions 116*c*, according to this embodiment, are directed toward the rear of the article of furniture 100 such that a user may lean back on the article of furniture 100 with additional support when the article of furniture is filled or substantially filled with sand 2.

The article of furniture 100 also includes one or more fill openings 140 (FIGS. 6 and 9) through the cover 114 into which a user can insert sand 2 when filling the internal volume with sand. At least one fill opening 140 is preferably incorporated in a back area 144 of the cover 114. Disposed at least partially over the fill opening 140 is a flap member 146, including at least one edge 148 coupled to the cover 114 using stitching, for example. As with the first embodiment, the edge 148 of the flap member 146 preferably is removably coupled to the cover 114 with an attachment assembly that may include hook and loop fasteners or patches or regions of complementary adhesive-based materials suitable for repeated connection and reconnection.

To facilitate positioning of the back rest 112 when substantially filled with sand 2, handles 156, 158*a*, 158*b* are connected to the cover 114. Also, to facilitate transport of the article of furniture 100 in its collapsed state as a portable structure, straps 160 are connected to the cover 114, which include adjustment elements 162 such as buckles or hook and loop fasteners that allow a user to change the overall length of the straps 160.

The article of furniture 100 optionally includes a fabric extension 166 coupled to the cover 130. The fabric extension 166 preferably is manufactured from an absorbent material that effectively absorbs water (e.g. terry cloth).

The portable structure 100*c* shown in its collapsed states in FIGS. 4A and 4B is converted to an article of furniture 100 (FIGS. 5-9) by (a) releasing the frame 116 to its unfolded or pop-up state; and (b) inserting sand into the internal volume of the cover 114 through openings 140 to fill or substantially fill the cover 114 with sand 2.

During use, after the article of furniture 100 is formed by filling or substantially filling the portable structure with sand 2, a user may lay against the formed back rest 112 and lay on top of the optional fabric extension 166. In addition, inflatable arm rests 170 may be attached to the cover 114 for additional user comfort. Each inflatable arm rest 170 includes an arm rest body 172, having a port 174 such that air may be blown into the internal volume of the arm rest to inflate the arm rest. The port 174 may be positioned in any area on the arm rest body 172. Preferably, the port 174 is disposed on a side surface 176 of the body 172 for easy user access.

FIG. 8 shows a modified version of the second embodiment of the convertible and collapsible article of furniture that includes an inflatable seat cushion 180. The inflatable seat cushion 180 includes a seat body having an upper surface 182, a bottom surface 184, and an intermediate surface 186 disposed between the upper surface 182 and the bottom surface 184. The seat cushion also includes a port 188 disposed on the seat body and preferably coupled to the intermediate surface 184 for user accessibility. The port 188 allows for air 4 (FIG. 9) to be blown into the internal volume of the seat cushion to inflate the seat cushion 180. In this version of the article of furniture 100, the back support portion 116*a* has a higher rise BR and a more elongated U-shape to accommodate the back of a user who sits on the seat cushion 180 after the article of furniture 100 is substantially filled with sand to form the back rest 112.

The inflatable seat cushion 180 preferably has a seat rise IR up to eighteen (18) inches (FIG. 9), where the inflatable seat rise IR is the distance from a generally horizontal topmost plane defined by the upper surface 182 and a generally horizontal bottommost plane defined by the bottom panel 130. The inflatable seat cushion 180 may be joined to the front panel 124 of the cover 114 with hook and loop fasteners or other releasable engagement means suitable for repeated connection and reconnection. Alternatively, the seat cushion 180 may be joined to the front panel 124 of the cover 114 by stitching or more permanent engagement means. As still another alternative, the seat cushion 180 may remain unconnected to the article of furniture 100, and may simply be used in conjunction therewith.

Figure 10:
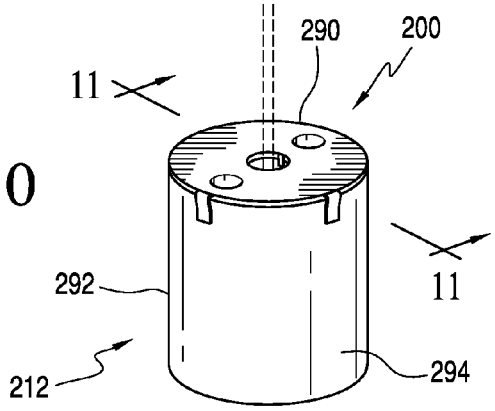
FIG. 10 is a front perspective view of a third embodiment of a convertible and collapsible article of furniture forming an umbrella table.
Figure 11:
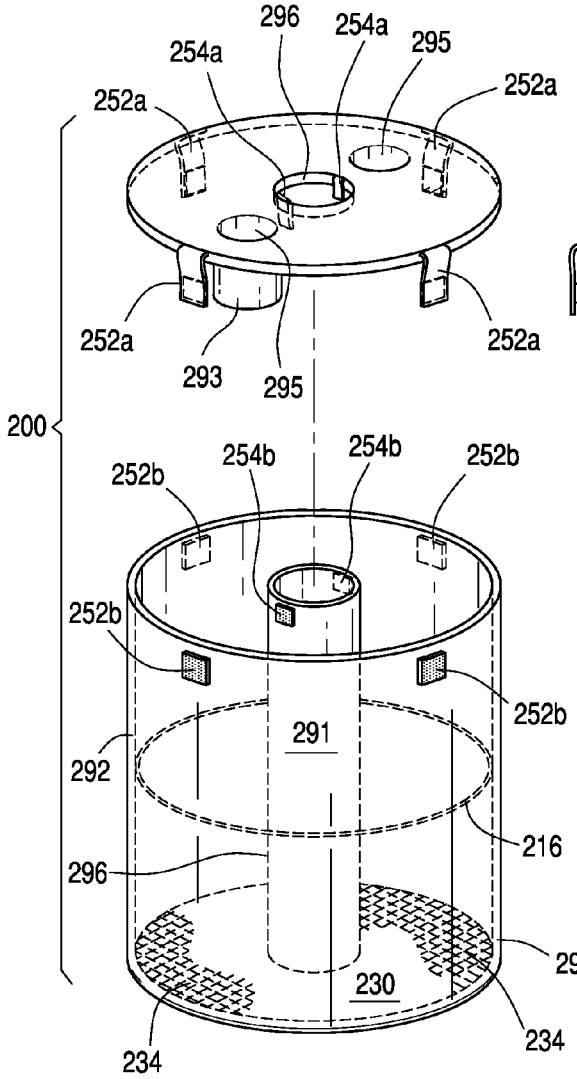
FIG. 11 is a partially exploded front perspective view of the convertible and collapsible article of furniture shown in FIG. 10.
Figure 12:
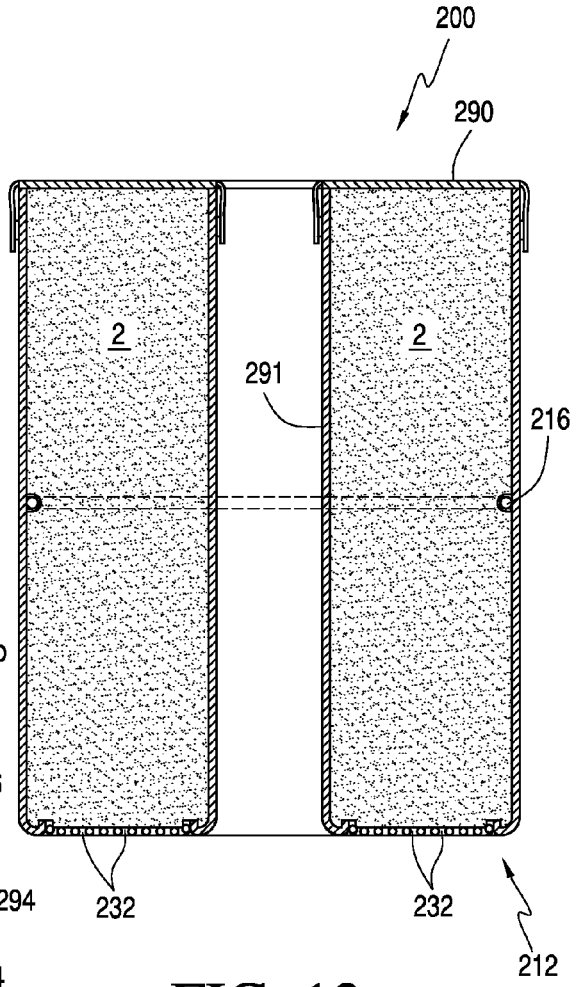
FIG. 12 is a cross-sectional view of the convertible and collapsible article of furniture shown in FIG. 10 taken along line 12-12 of FIG. 10.

FIGS. 10-13 show a third embodiment of a convertible and collapsible article of furniture 200 that converts from a portable structure to an umbrella table 212, configured to hold an umbrella 300 when the article of furniture 200 is uprightly positioned and filled with sand 2 (FIG. 12). The article of furniture 200 includes a top cover 290 and a collapsible bottom structure 292, which includes an outer cylinder 294, an inner cylinder within the outer cylinder 294, and a bottom panel 230. The top cover 290 is preferably removable. However, it may be attached to or integral with the collapsible bottom structure 292. At least one circular frame 216 may be disposed on or within the outer cylinder 294 such that the collapsible bottom 292 has additional structural support when the inner and outer cylinders, 294 are uprightly positioned (i.e., not collapsed), as shown in FIGS. 10 and 11. An internal volume space between the inner cylinder and outer cylinder 294 is adapted for receiving sand 2.

The top 290 may be attached to the collapsible bottom structure 292 with an outer attachment assembly 250 and an inner attachment assembly 251. The attachment assemblies 250, 251 include connectors 252*a*, 252*b*, 254*a*, 254*b* (FIG. 11) positioned on complementary surfaces of the top 290 and the collapsible bottom 292. The connectors 252*a*, 252*b*, 254*a*, 254*b* may be, for example hook and loop fasteners, or complementary adhesive based materials that are suitable for repeated connection and reconnection.

Preferably, the top 290 further includes holes, recesses or pockets that form beverage placeholders 293. In the embodiment shown in FIG. 11, pockets extend downwardly from openings 295 formed in the top 290. An umbrella hole 296 is also incorporated into the top 290 that couples with the inner cylinder 291 of the collapsible bottom 292.

Figure 13:
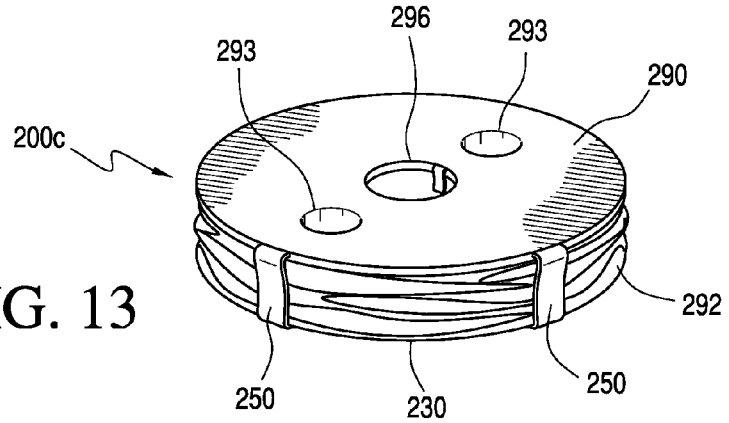
FIG. 13 is a front perspective view of the convertible and collapsible article of furniture, shown in FIG. 10 in a collapsed state.

The portable structure 200*c* shown in its collapsed states in FIG. 13 is converted to an article of furniture 200 (FIGS. 10-12) by (a) raising the upper edges of the inner cylinder and outer cylinder 294; (b) inserting sand into the internal volume space between the inner cylinder and outer cylinder 294 to fill or substantially fill the portable structure 200*c* with sand 2; and (c) installing the top cover 290 over the sand-filled internal volume space and connecting the attachment assemblies 250, 251.

The bottom panel 230 preferably includes openings 232 that allow sand 2 to fall through to release sand from the article of furniture 200. The openings 232 are may extend over the entire bottom panel or be incorporated into discrete sections 234 of the panel, as shown in FIG. 11. Alternatively, the bottom panel 230 may be formed of netting or mesh. Upon removal of all or substantially all of the sand 2 from the umbrella table 212, the article of furniture 200 may be collapsed, as shown in FIG. 13.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A convertible and collapsible article of furniture, comprising:

a cover comprising a flexible and substantially deformable material and having an exterior surface and an interior surface and defining an interior volume adapted to receive sand, said cover defining at least one fill opening communicating with the interior volume, and said cover having a plurality of panels with at least one of said plurality of panels comprising a bottom panel, wherein said bottom panel defines a plurality of sand-releasing openings therein;

a frame coupled to the cover, the frame comprising at least one flexible frame member that is bendable into a collapsed state and releasable into an uncollapsed pop-up state, and comprising a back support portion, a base support portion, and one or more transition portions positioned between the back support portion and the base support portion; and at least one inflatable arm rest, wherein the cover and the frame together form a collapsed portable structure that converts into the article of furniture once (a) the frame recovers or substantially recovers from its collapsed state to its uncollapsed pop-up state, and (b) the interior volume is substantially filled with sand.

2. The article of furniture of claim 1, wherein the cover defines a plurality of fill openings communicating with the interior.

3. The article of furniture of claim 1, further comprising a fabric extension or flap connected to the cover to cover the at least one fill opening.

4. The article of furniture of claim 1, further comprising an inflatable seat cushion connected to the cover.

5. The article of furniture of claim 1, further comprising one or more handles disposed on the exterior surface of the cover.

6. The article of furniture of claim 1, further comprising one or more adjustment elements disposed on the exterior surface of the cover.

7. The article of furniture of claim 1, wherein the article of furniture is a chair or a back rest.

8. The article of furniture of claim 7, wherein the article of furniture is a chair, and the chair has a seat rise, extending from a seat area and the bottom panel of the cover, of up to about eighteen inches.

9. A convertible and collapsible article of furniture, comprising:

a cover comprising a flexible and substantially deformable material and having an exterior surface and an interior surface and defining an interior volume adapted to receive sand, said cover defining at least one fill opening communicating with the interior volume, and said cover having a plurality of panels with at least one of said plurality of panels comprising a bottom panel, wherein said bottom panel defines a plurality of sand-releasing openings therein;

a frame coupled to the cover, the frame comprising at least one flexible frame member that is bendable into a collapsed state and releasable into an uncollapsed pop-up state, and comprising a back support portion, a base support portion, and one or more transition portions positioned between the back support portion and the base support portion; and an inflatable seat cushion connected to the cover, wherein the cover and the frame together form a collapsed portable structure that converts into the article of furniture once (a) the frame recovers or substantially recovers from its collapsed state to its uncollapsed pop-up state, and (b) the interior volume is substantially filled with sand.

10. The article of furniture of claim 9, wherein the cover defines a plurality of fill openings communicating with the interior.

11. The article of furniture of claim 9, further comprising a fabric extension or flap connected to the cover to cover the at least one fill opening.

12. The article of furniture of claim 9, further comprising one or more handles disposed on the exterior surface of the cover.

13. The article of furniture of claim 9, wherein the article of furniture is a chair or a back rest.

* * * * *